US007841493B2

(12) United States Patent
Park et al.

(10) Patent No.: US 7,841,493 B2
(45) Date of Patent: Nov. 30, 2010

(54) DISPENSER AND REFRIGERATOR INCLUDING THE SAME

(75) Inventors: Kyong Bae Park, Seoul (KR); Sung Jhee, Seoul (KR); Nam Soo Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 434 days.

(21) Appl. No.: 11/936,246

(22) Filed: Nov. 7, 2007

(65) Prior Publication Data

US 2008/0121667 A1 May 29, 2008

(30) Foreign Application Priority Data

Nov. 13, 2006 (KR) ..... 10-2006-0111905

(51) Int. Cl.
*B65D 47/00* (2006.01)

(52) U.S. Cl. ..... 222/477; 141/361; 62/344

(58) Field of Classification Search ..... 222/477, 222/146.6; 62/344, 266; 188/286–293, 322.16–322.22; 141/360–362
See application file for complete search history.

(56) References Cited

U.S. PATENT DOCUMENTS 6,135,173 A * 10/2000 Lee et al. ..... 141/361
6,176,475 B1 * 1/2001 Bella et al. ..... 267/120
7,302,809 B2 * 12/2007 Park ..... 62/344

FOREIGN PATENT DOCUMENTS

| | | |
|---|---|---|
| CN | 1227908 A | 9/1998 |
| CN | 1793762 A | 6/2006 |
| KR | 1999-0060081 | 7/1999 |
| KR | 2000-0003901 | 2/2000 |
| KR | 10-0624711 | 8/2006 |
| KR | 10-2008-0021960 | 3/2008 |

OTHER PUBLICATIONS

International Search Report and dated Sep. 24, 2008.
Written Opinion of the International Searching Authority dated Sep. 24, 2008.

* cited by examiner

*Primary Examiner*—Lien T Ngo
(74) *Attorney, Agent, or Firm*—KED & Associates, LLP

(57) ABSTRACT

A dispenser for a refrigerator is provided. The dispenser may include a cover which opens or shuts an opening of a duct that guides contents from an interior of the refrigerator to the dispenser for discharge. An actuator transmits an externally applied force to the cover to cause the cover to move and selectively open and shut the opening. A regulator controls action of the actuator to adjust movement of the cover.

27 Claims, 16 Drawing Sheets

DISPENSER AND REFRIGERATOR INCLUDING THE SAME

CROSS-REFERENCE TO RELATED APPLICATION

This application claims the benefit of Korean Patent Application No. 111905/2006 filed in Korea on Nov. 13, 2006, the entirety of which is incorporated herein by reference.

BACKGROUND

1. Field

This relates to a dispenser for a refrigerating system, and more particularly to a dispenser that dispenses contents such as, for example, ice and/or water from a refrigerator.

2. Background

Dispensers are typically provided in a freezing chamber door of a refrigerator to allow contents such as, for example, ice and/or water to be easily dispensed without opening the door. However, the structure that operates the dispenser can be complicated and generate noise, thus adding to manufacturing cost and complexity and detracting from customer satisfaction.

BRIEF DESCRIPTION OF THE DRAWINGS

The embodiments will be described in detail with reference to the following drawings in which like reference numerals refer to like elements wherein.

DETAILED DESCRIPTION

Figure 1A:
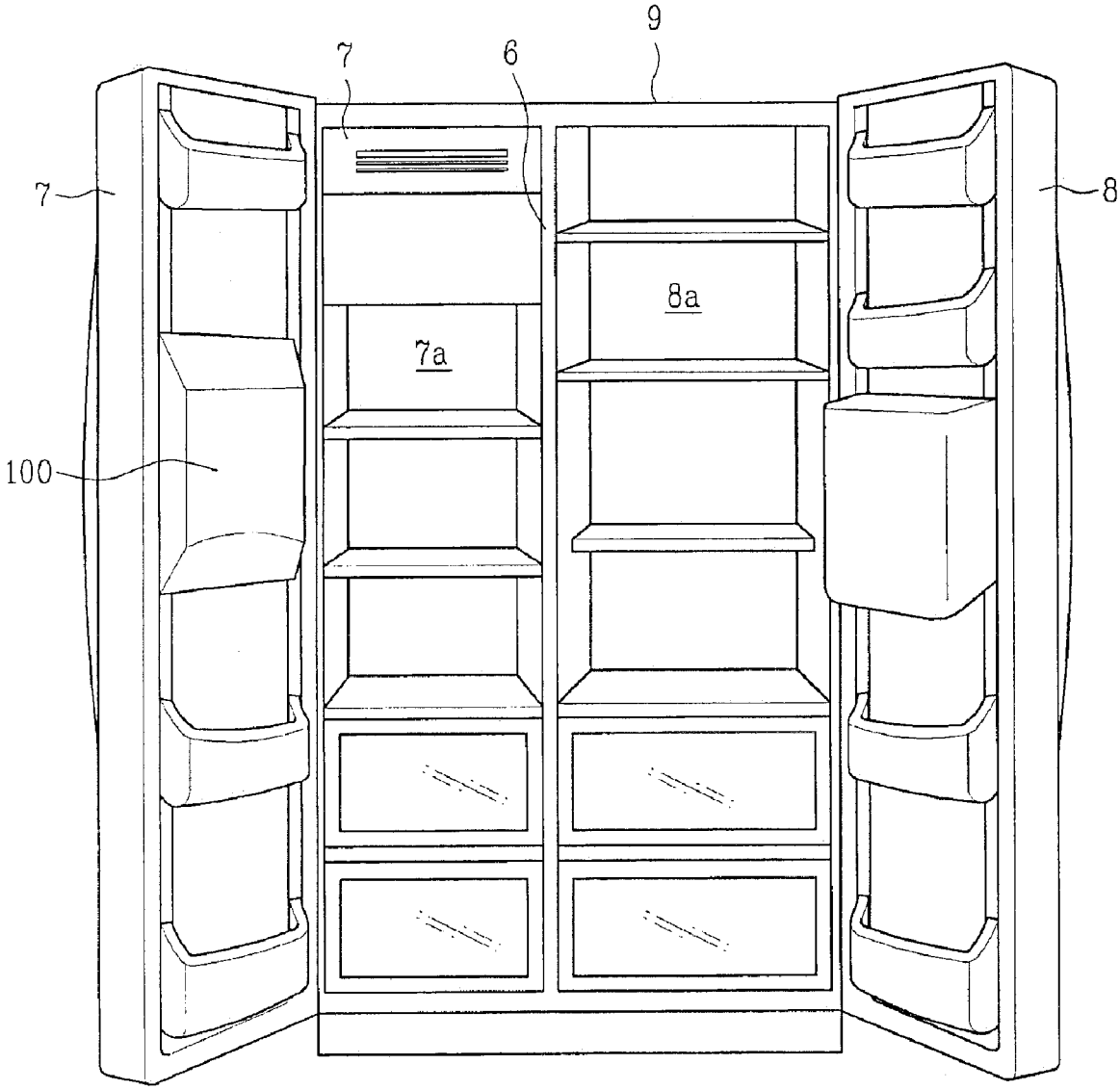
FIGS. 1A-1B are front views of refrigerators having dispensers as embodied and broadly described herein.

A structure of an exemplary refrigerator including a dispenser as embodied and broadly described herein will be described with reference to FIGS. 1A-1B and 2.

The refrigerator may include a main body 9 including a freezing chamber 7*a* and a cooling chamber 8*a* each closed by a respective door 7 and 8. A dispenser 100 in communication with an ice maker 5 may be provided on one of the doors 7 and 8 to discharge contents from the refrigerator without opening the doors 7 and 8.

Simply for each of discussion, hereinafter a refrigerator 9 having the freezing chamber 7*a* and the cooling chamber 8*a* arranged side by side at left and right compartments of the main body 9, respectively, separated by a partition 6 will be referred to. However, it is well understood that a dispenser as embodied and broadly described herein may also be applied to differently configured refrigeration systems, as shown, for example, in FIGS. 14A-14G.

Figure 1B:
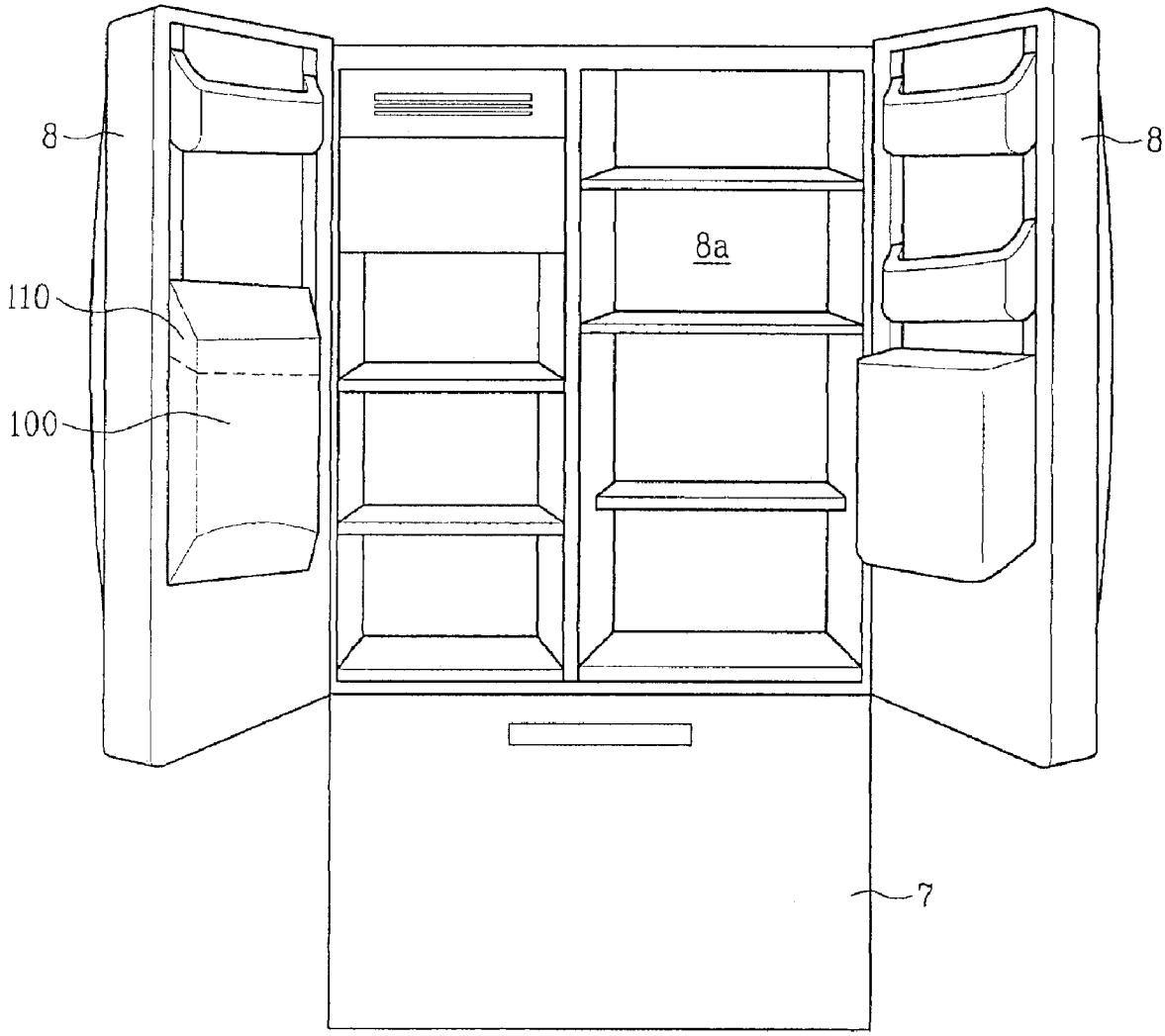
Figure 2:
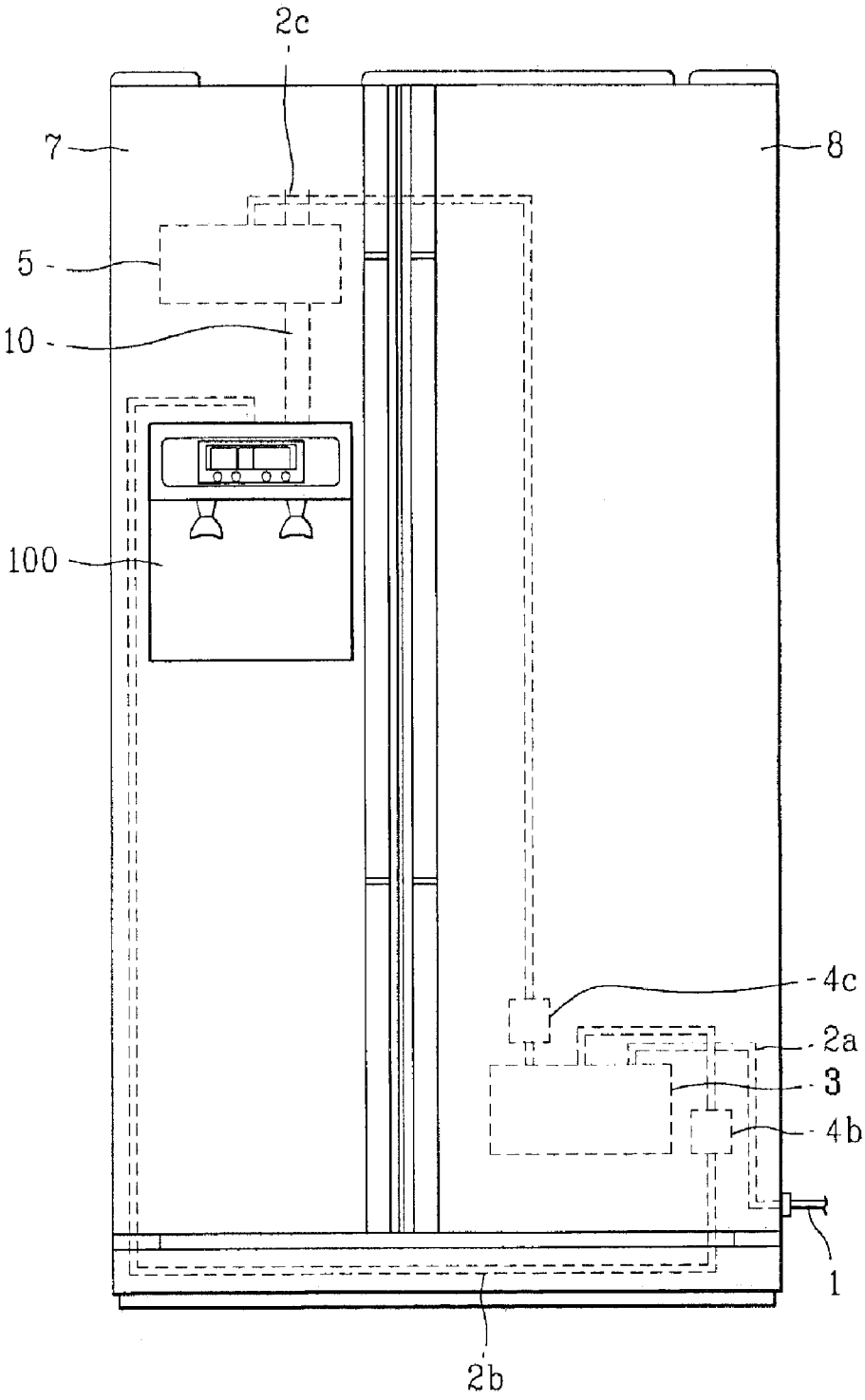
FIG. 2 is a front view of the exemplary refrigerator shown in FIG. 1A.

As shown in FIGS. 1A and 2, the dispenser 100 may be installed on the front surface of the freezing chamber door 7 such that a desired content such as water and/or ice may be dispensed from the refrigerator without opening the door 7. Further, the ice maker 5 may be installed in the freezing chamber door 7 or the freezing chamber 7*a* to freeze water into ice. In alternative embodiments, both the ice maker 5 and the dispenser 100 may be installed in either the freezing chamber door 7 or the cooling chamber door 8.

An ice discharging duct 10 may connect the ice maker 5 with the dispenser 100. A water storage chamber 3 may be installed in the cooling chamber 8*a* to store water to be supplied to the dispenser 100 and the ice maker 5. Valves 4*b* and 4*c* may control the amount of water supplied to the dispenser 100 and the ice maker 5.

Water stored in the water storage chamber 3 may pass through a lower portion of the refrigerator 9 along a first water supply pipe 2*b* to be supplied to the dispenser 100. Water may also supplied along a second water supply pipe 2*c* to the ice maker 5. The water storage chamber 3 may be supplied with water through a water supply pipe 2*a* from a water connecting pipe 1.

A structure of the dispenser 100 in accordance with an embodiment as broadly described herein will now be described in detail with reference to FIGS. 3 and 4.

The dispenser 100 may include a cover 120 which selectively opens and shuts an opening formed at an end portion of the discharging duct 10, an actuator which transmits force to drive the cover 120, and a regulator which controls the action of the actuator. The actuator may include a lever 110 and a transmitter. More specifically, as force is applied to the lever 110, the transmitter transmits the force applied to the lever 110 to the cover 120 to open the cover 120 and allow contents to be dispensed through the duct 10.

Figure 3:
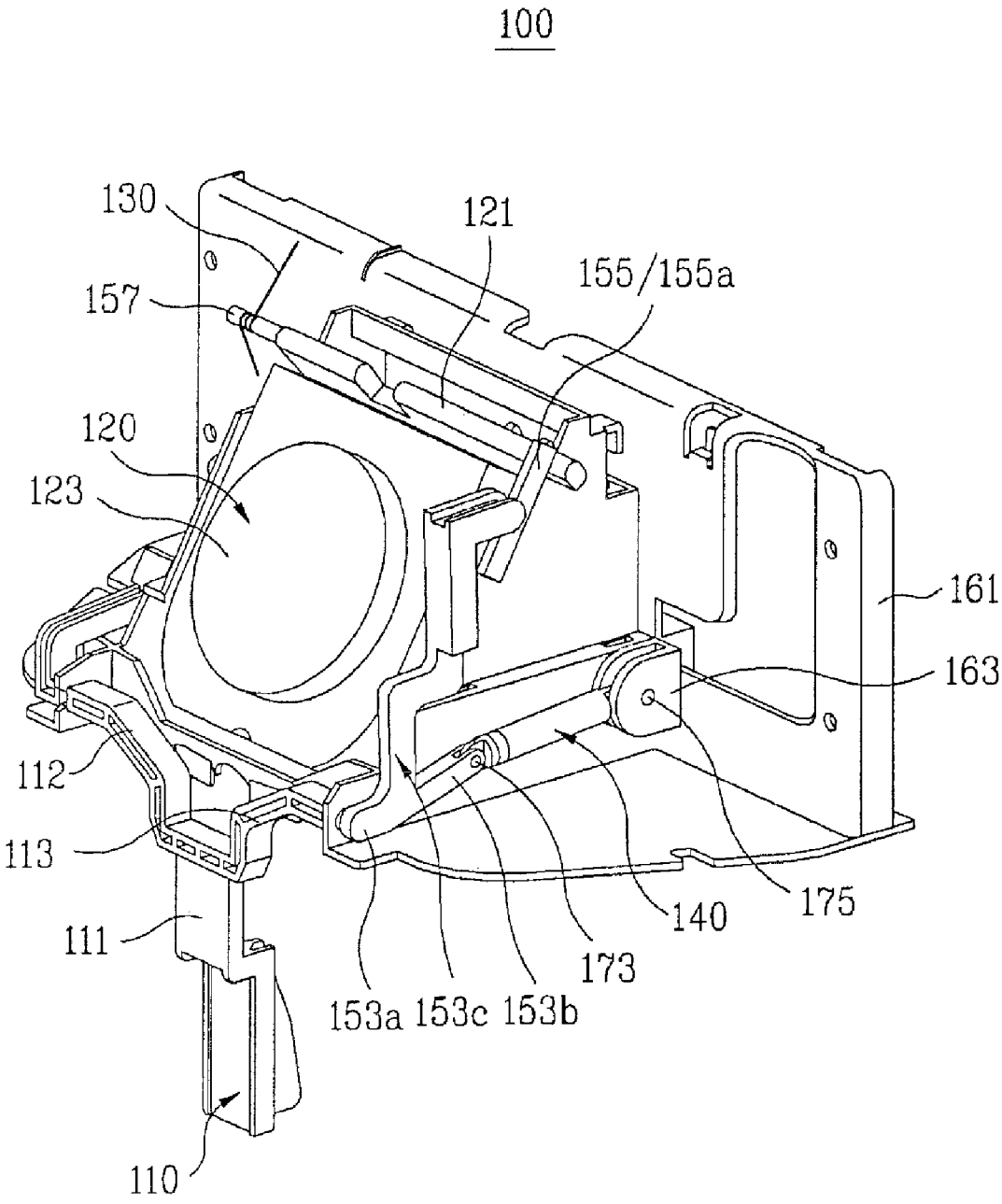
FIG. 3 is a perspective view of a dispenser included in the exemplary refrigerators shown in FIGS. 1A-1B and 2 when a cover of the dispenser is closed, in accordance with embodiments as broadly described herein.
Figure 4:
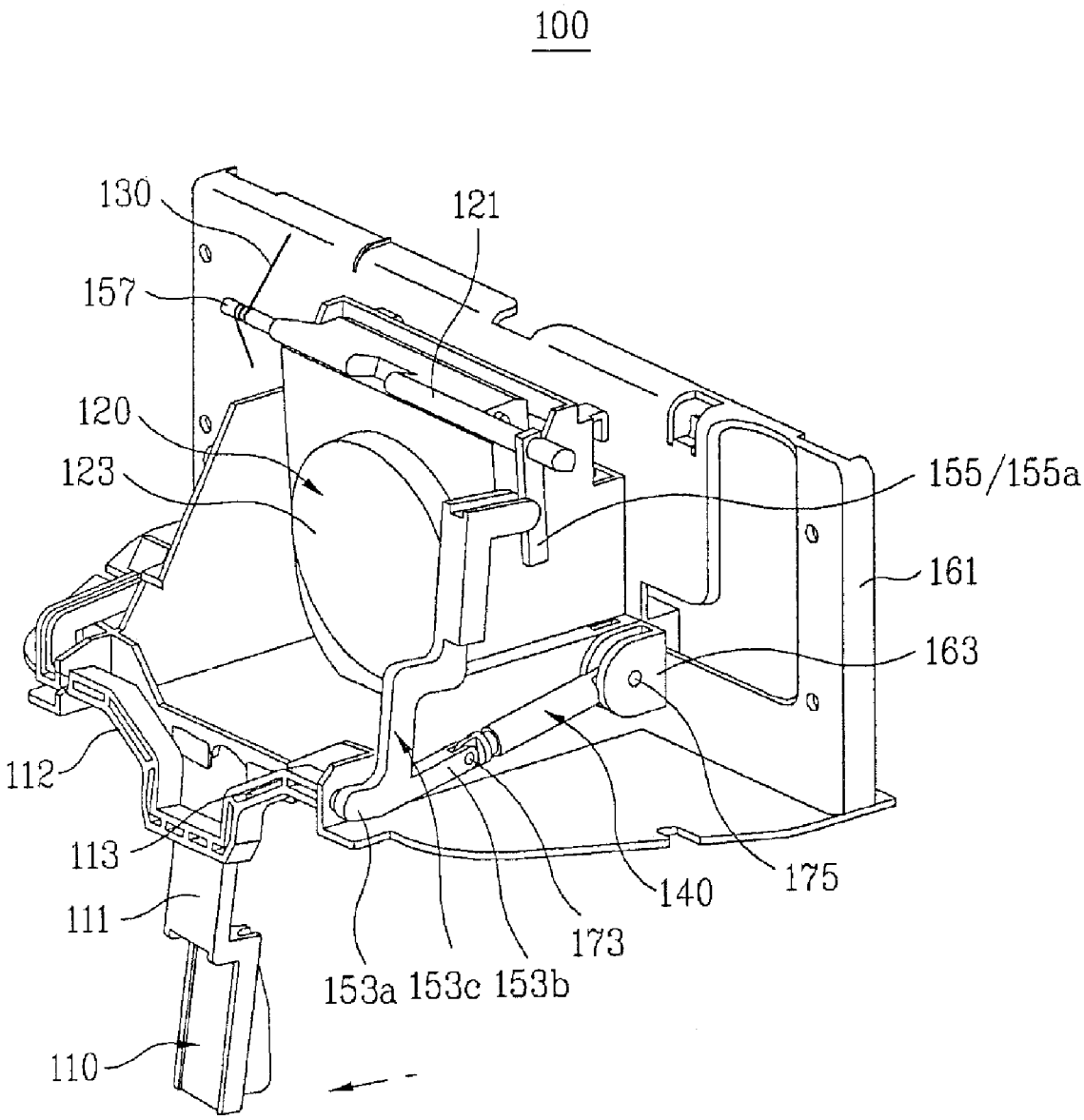
FIG. 4 is a perspective view of the dispenser shown in FIG. 3 when a cover of the dispenser is open.

As shown in FIGS. 3 and 4, the regulator may include an elastic member 130 and a damping member 140. The elastic member 130 may apply elastic force to the cover 120 as it is opened or closed. Specifically, when external force applied to the lever 110 is removed, the elastic member 130 supplies a restoration force to the cover 120 that urges the cover 120 back to a closed position, as shown in FIG. 3. The damping member 140 may regulate opening and shutting of the cover 120 through its interaction with the elastic member 130.

The lever 110 may include a main lever 111 that contacts a container for receiving contents discharged from the dispenser 100, a first split lever 112 that extends on the left side of the main lever 111 in FIGS. 3-4, and a second split lever 113 that extends on the right side of the main lever 111 in FIGS. 3-4. In certain embodiments, the main lever 111, the first split lever 112 and the second split lever 113 may be formed as a single body.

The cover 120 may include a door plate 123 corresponding to the ice discharging duct 10 shown in FIG. 2 and a door rotating rod 121 that extends from the door plate 123.

The transmitter may include a shaft 157 coupled to the cover 120, linking members 153*a*, 153*b* and 153*c* that move in response to a rotation of the lever 110, and a converter 155 that converts movement of the linking members 153*a*, 153*b* and 153*c* to a corresponding rotation of the shaft 157. The shaft 157 may be coupled to the door rotating rod 121 to rotate the cover 120 to selectively open and shut the ice discharging duct 10. That is, the shaft 157 may be rotated by the linking members 153*a*, 153*b* and 153*c* and the converter 155. The elastic member 130 may apply an elastic restoration force to the shaft 157 that causes the shaft 157 to return to an original position.

In certain embodiments, linking members 153*a*, 153*b* and 153*c* include a lever link 153*a* connected to the lever 110, a first link 153*b* connected to the damping member 140, and a second link 153*c* connected to the converter 155. The lever link 153*a*, the first link 153*b* and the second link 153*c* may be formed as a single body. An external force applied to the lever 110 causes the linking members 153*a*, 153*b* and 153*c* to also move relative to the lever 110. The lever link 153*a* may be connected to the lever 110, i.e., the first split lever 112 and the second split lever 113, by a first connector 171 (see FIG. 8). When the first split lever 112 and the second split lever 113 rotate, the linking members 153*a*, 153*b* and 153*c* move relative to the lever 110.

In certain embodiments, converter 155 may be an actuating member 155*a* as shown in FIGS. 3-6. The actuating member 155*a* may be provided between the shaft 157 and the linking members 153*a*, 153*b* and 153*c* to convert the movement of the linking members 153*a*, 153*b* and 153*c* to the rotation of the shaft 157. Specifically, the actuating member 155*a* may engage with the second link 153*c* to transmit the movement of the second link 153*c* to the shaft 157. In certain embodiments, the actuating member 155*a* and the shaft 157 may be formed as a single body. In alternative embodiments, the actuating member 155*a* may be coupled to the shaft 157.

Figure 5:
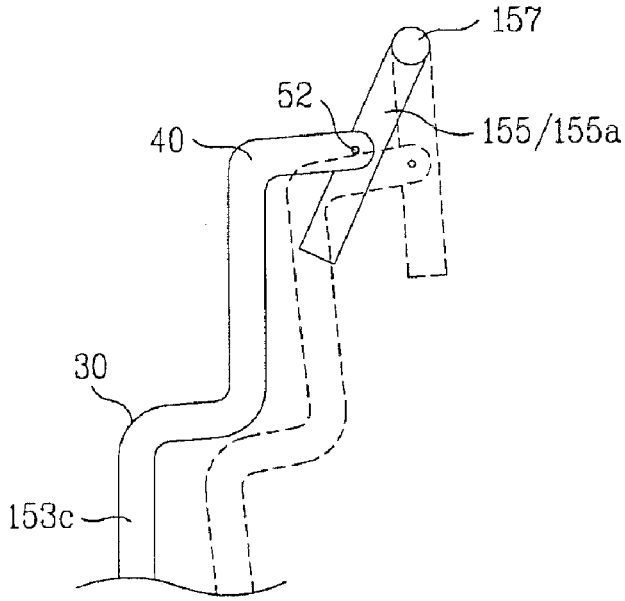
FIGS. 5 and 6 are side views of a second link and an actuating member of the dispenser shown in FIGS. 3-4.
Figure 6:
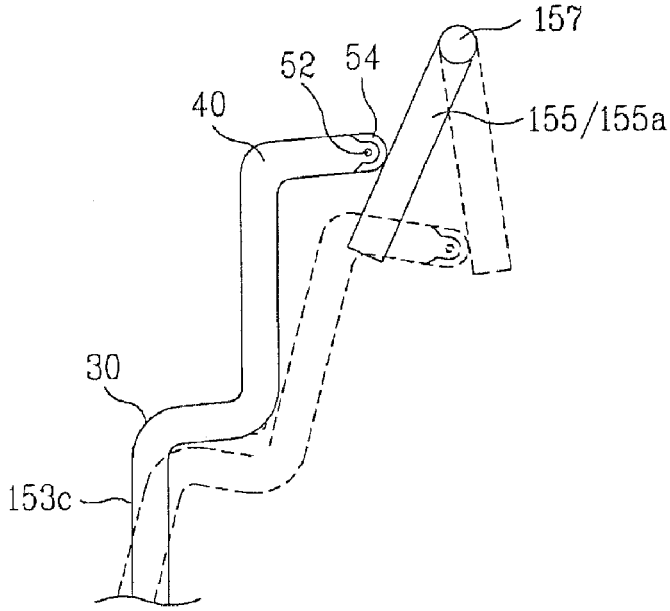

As shown in FIGS. 5 and 6, the second link 153*c* may include bending portions 30 and 40. These bending portions 30 and 40 allow the second link 153*c* to easily transmit force to the actuating member 155*a*. Further, the bending portions 30 and 40 may also prevent the second link 153*c* from being damaged due to stress or fatigue generated while the second link 153*c* transmits force to the actuating member 155*a*.

In the embodiment shown in FIG. 5, a connecting portion 52 may be formed by connecting, or rotatably coupling, an end portion of the second link 153*c* with the actuating member 155*a*. Thus, when the second link 153*c* is actuated, the second link 153*c* rotates around the connecting portion 52 while the end portion of the second link 153*c* pushes the actuating member 155*a*, as shown in shadow in FIG. 5.

In the embodiment shown in FIG. 6, the end portion of the second link 153*c* simply contacts the actuating member 155*a* without necessarily being connected or coupled thereto. Thus, when the second link 153*c* is actuated, an end portion of the second link 153*c* slides along a surface of the actuating member 155*a*, pushing the actuating member 155*a*. A roller 54 may be provided at the end portion of the second link 153*c* to facilitate this sliding motion and lessen friction between the end portion of the second link 153*c* and the surface of the actuating member 155*a*.

Figure 7:
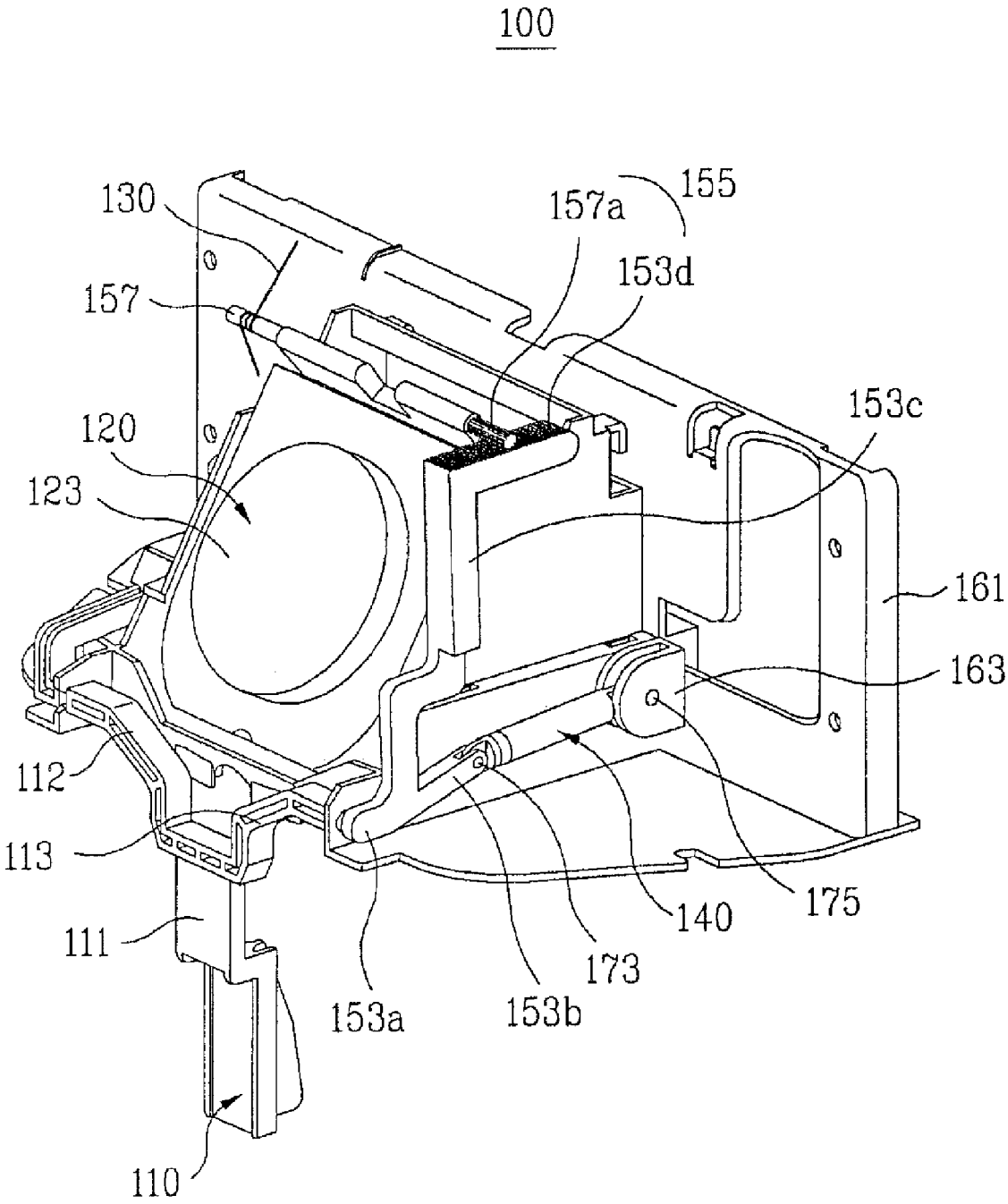
FIG. 7 is a perspective view of a dispenser in accordance with another embodiment as broadly described herein.

A dispenser in accordance with another embodiment as broadly described herein is shown in FIG. 7. The description of similar components is omitted to avoid redundancy.

As shown in FIG. 7, the converter 155 may be embodied as an actuating gear including a gear, a screw or the like provided in the shaft 157 and/or the linking members 153*a*, 153*b* and 153*c*. The embodiment shown in FIG. 7 includes a first gear provided in the shaft 157 and a second gear provided in the second link 153*c* that engage with each other to convert the movement of the second link 153*c* to the rotation of the shaft 157. More specifically, the first gear may be pinion gear part 157*a*, and the second gear may be a rack gear part 153*d*. The pinion gear part 157*a* and the rack gear part 153*d* together form the converter 155 that converts the movement of the lever 110 and second link 153*c* to a rotation of the shaft 157. However, it is well understood that the converter 155 may be any element capable of converting the rotation or the linear movement of the linking members 153*a*, 153*b*, 153*c* to the rotation of the shaft 157.

The elastic member 130 may be connected to the shaft 157 to apply an elastic restoration force to the shaft 157 that has been rotated away from its at rest position due to the externally applied force. The opposite ends of the elastic member 130 may be fixed to an inner surface of a dispensing case 161. The elastic member 130 may support the shaft 157 while also supplying restoration force to the shaft 157. Although the elastic member 130 shown in FIGS. 3, 4 and 7 is a torsion spring, the elastic member 130 may be any element capable of supplying elastic restoration force to the shaft 157 when external force is removed, independent of a separate installation structure and shape.

The damping member 140 may be connected to the linking member, i.e., the first link 153*b* to apply tensile force and compressive force to the movement of the first link 153*b*. Specifically, one side of the damping member 140 may be connected to the first link 153*b* via a second connector 173. The other side of the damping member 140 may be connected to a bracket 163 provided with the dispensing case 161 via a third connector 175.

Figure 8:
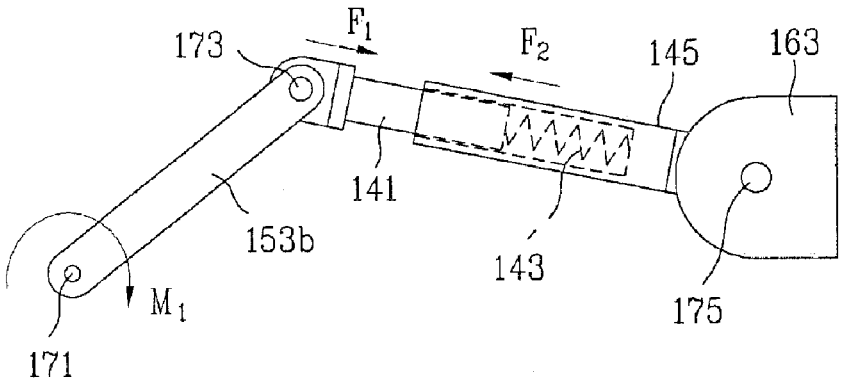
FIGS. 8-10 illustrate an operation process of the dispenser shown in FIG. 3 as the cover is opened.
Figure 9:
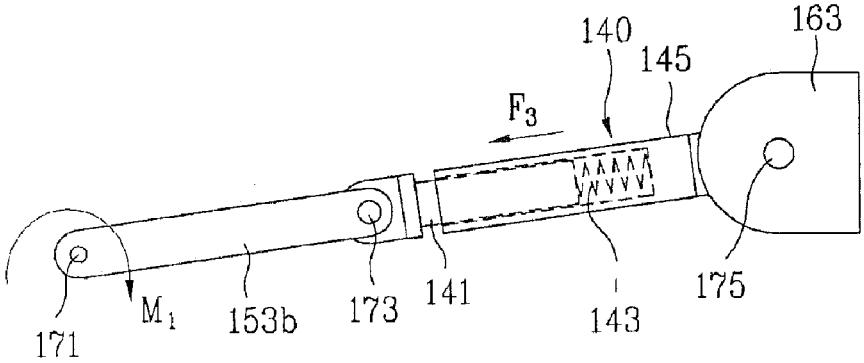
Figure 10:
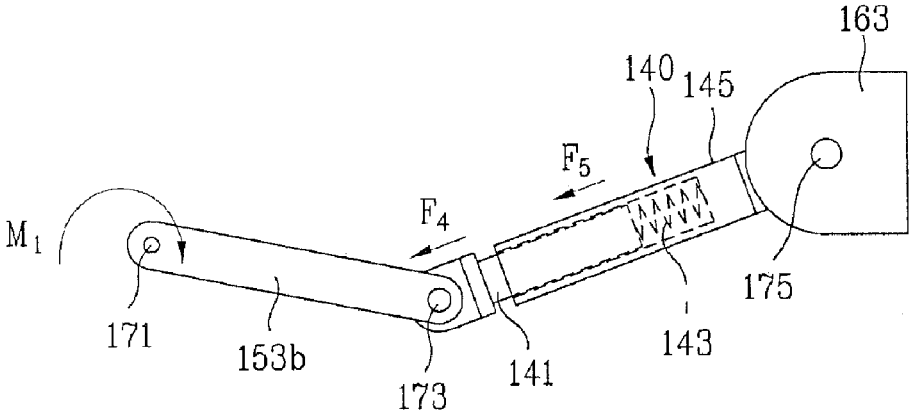

The structure of the damping member 140 and a process of opening the cover 120 of the dispenser 100 will be described with reference to FIGS. 4 and 8-10. FIG. 8 shows the damping member 140 when the cover 120 is fully closed. FIG. 9 shows the damping member 140 when the cover 120 has moved from the fully closed position to a partially open position. FIG. 10 shows the damping member 140 when the cover 120 is fully open.

The damping member 140 may include a first damping part 141 connected to the first link 153*b* so as to move in response to rotation of the lever 110, a second damping part 145 connected to the bracket 163 so as to move relative to the first damping part 141, and a third damping part 143 installed between the first damping part 141 and the second damping part 145. A portion of the first damping part 141 may be inserted into the second damping part 145 and move within the second damping part 145. The third damping part 143 may be installed between one end of the first damping part 141 and an inner end portion of the second damping part 145 to supply force corresponding to the movement of the first damping part 141.

The damping member 140 not only has elastic restoration force, but may also decrease the effect of an external impact. In certain embodiments, the third damping part 143 may be a spring. A fluid may be filled in a space between the first damping part 141 and the second damping part 145. That is, fluid may be filled in an inner space of the second damping part 145 and the third damping part 143 may also be installed in the second damping part 145.

When an external force is applied to the lever 110, the main lever 111 moves toward the left, as indicated by an arrow in FIG. 4. Then, the second split lever 113 having one end extending from the main lever 111 and the other end connected to the first connector 171 rotates at a portion connected to the first connector 171.

The rotation of the second split lever 113 causes all of the linking members 153*a*, 153*b*, 153*c* to rotate. A clockwise moment M1 is applied to the first link 153*b* by the second split lever 113. The first damping part 141 is pushed by a first compressive force F1 due to the rotation of the first link 153*b*. Then, the third damping part 143 is compressed by the first damping part 141, while also storing a first elastic restoration force F2 in the opposite direction to the first compressive force F1.

Thereafter, as the first link 153*b* continues to push the first damping part 141, elastic restoration force due to the third damping part 143 gradually increases. The third damping part 143 has a maximum elastic restoration force F3 when the first link 153*b* and the damping member 140 are arranged in a straight line, as shown in FIG. 9.

The second link 153*c* rotates to actuate the converter 155, and the converter 155 rotates the shaft 157. Then, the shaft 157 rotates the cover 120 to open the ice discharging duct 10. As the first link 153*b* continues to rotate, the first link 153*b* has a first tensile force F4 that draws the first damping part 141 to a certain extent. The third damping part 143 has a second elastic restoration force F5 in the same direction as a moving direction of the first damping part 141.

The ice discharging duct 10 may be connected to an ice bank (not shown). The ice bank may include a motor that may be actuated by a movement of the lever 110 to discharge ice. More specifically, rotation of the lever 110 may actuate a micro switch (not shown) provided in the dispenser 100 to drive the motor to transmit ice from the ice bank to the ice discharging duct 10. When the externally applied force is removed, the micro switch is turned off and the operation of the motor is stopped.

Figure 11:
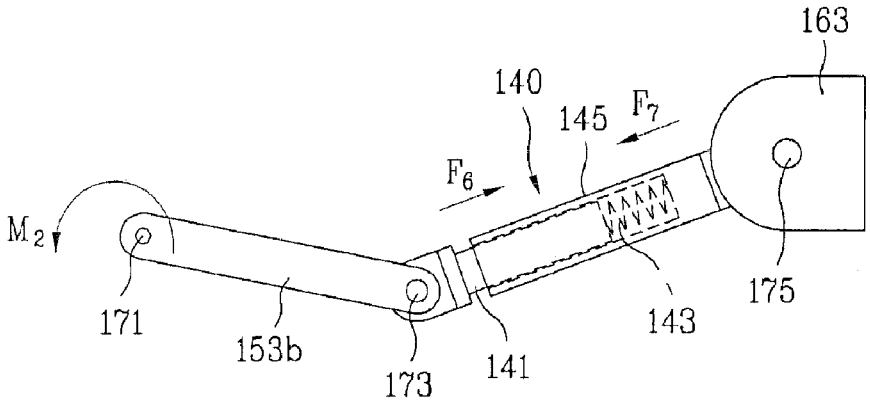
FIGS. 11-13 illustrate an operation process of the dispenser shown in FIG. 3 as the cover is closed.
Figure 12:
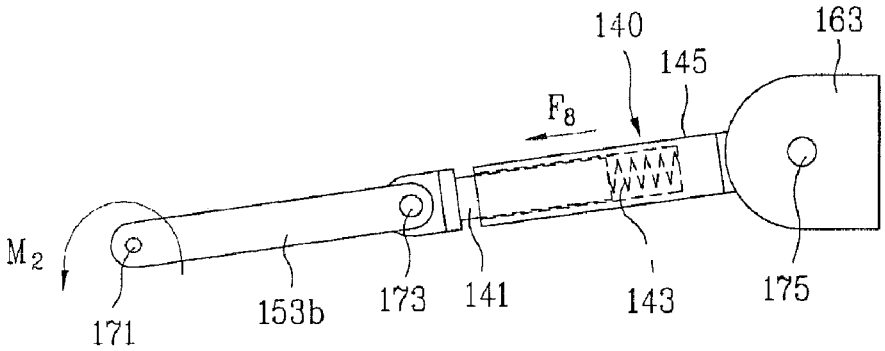
Figure 13:
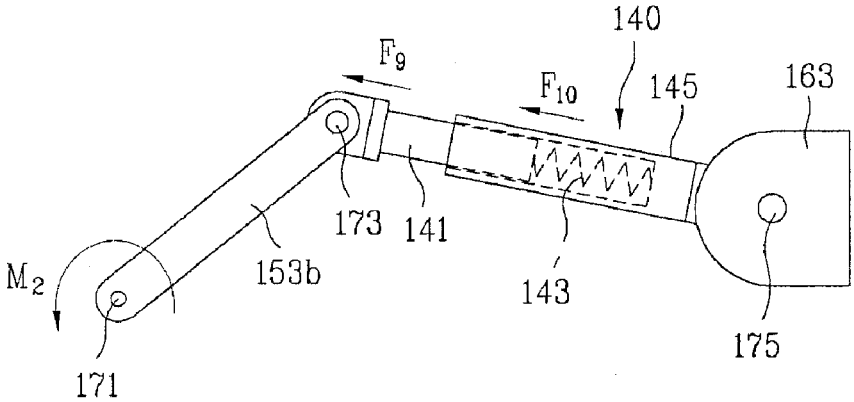
Figure 14A:
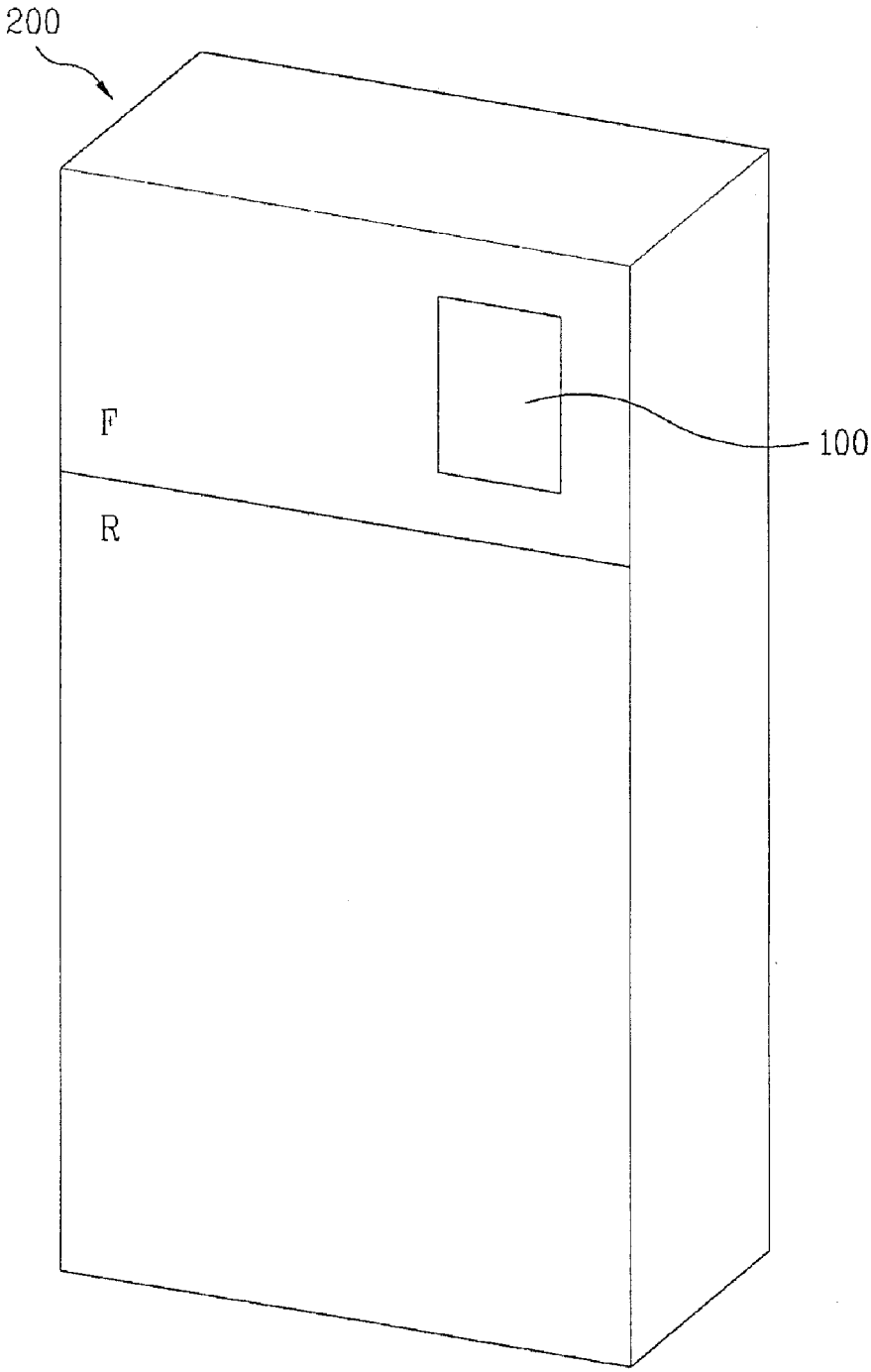
FIGS. 14A-14G illustrate dispensers as embodied and broadly described herein installed in exemplary refrigerating systems.
Figure 14B:
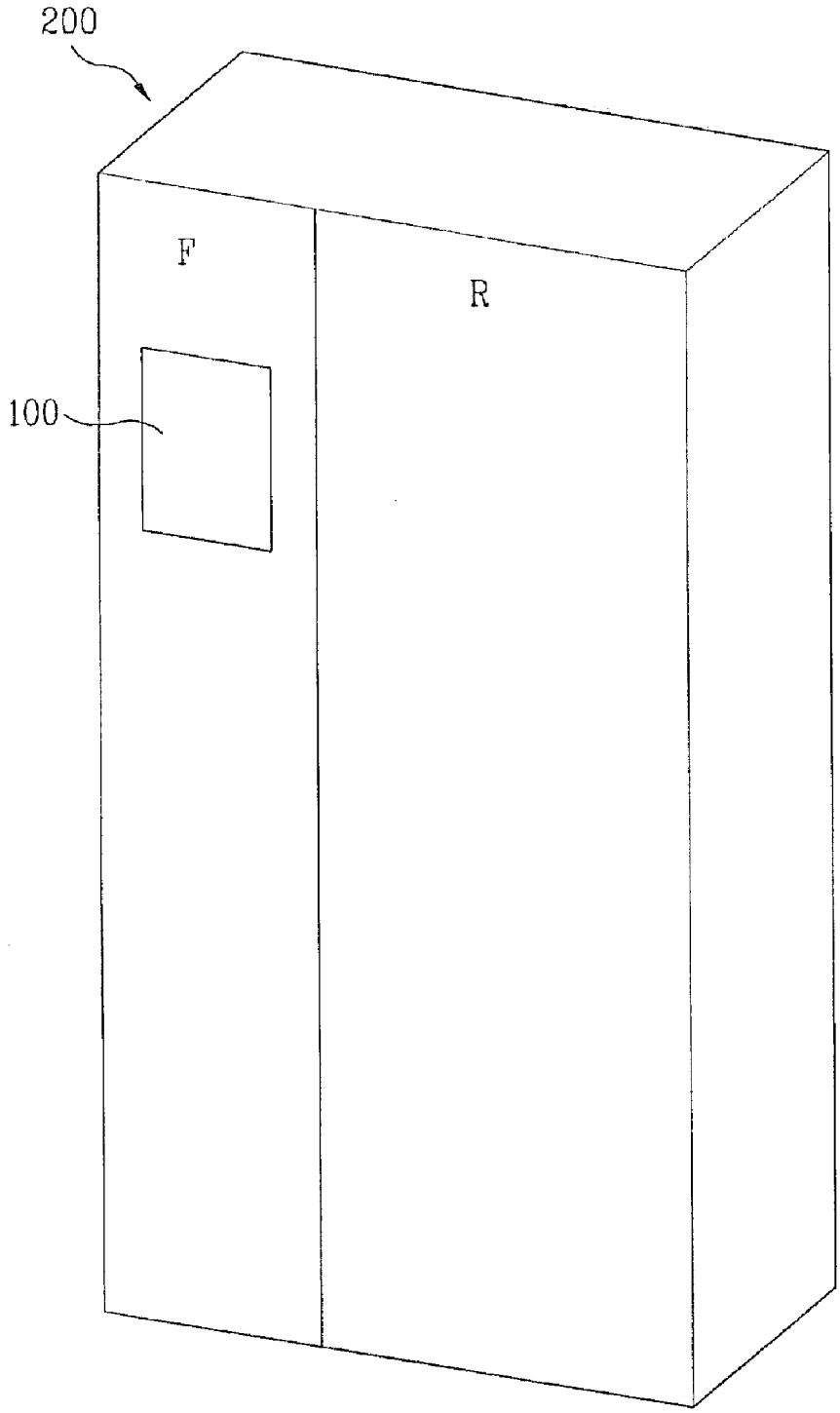
Figure 14C:
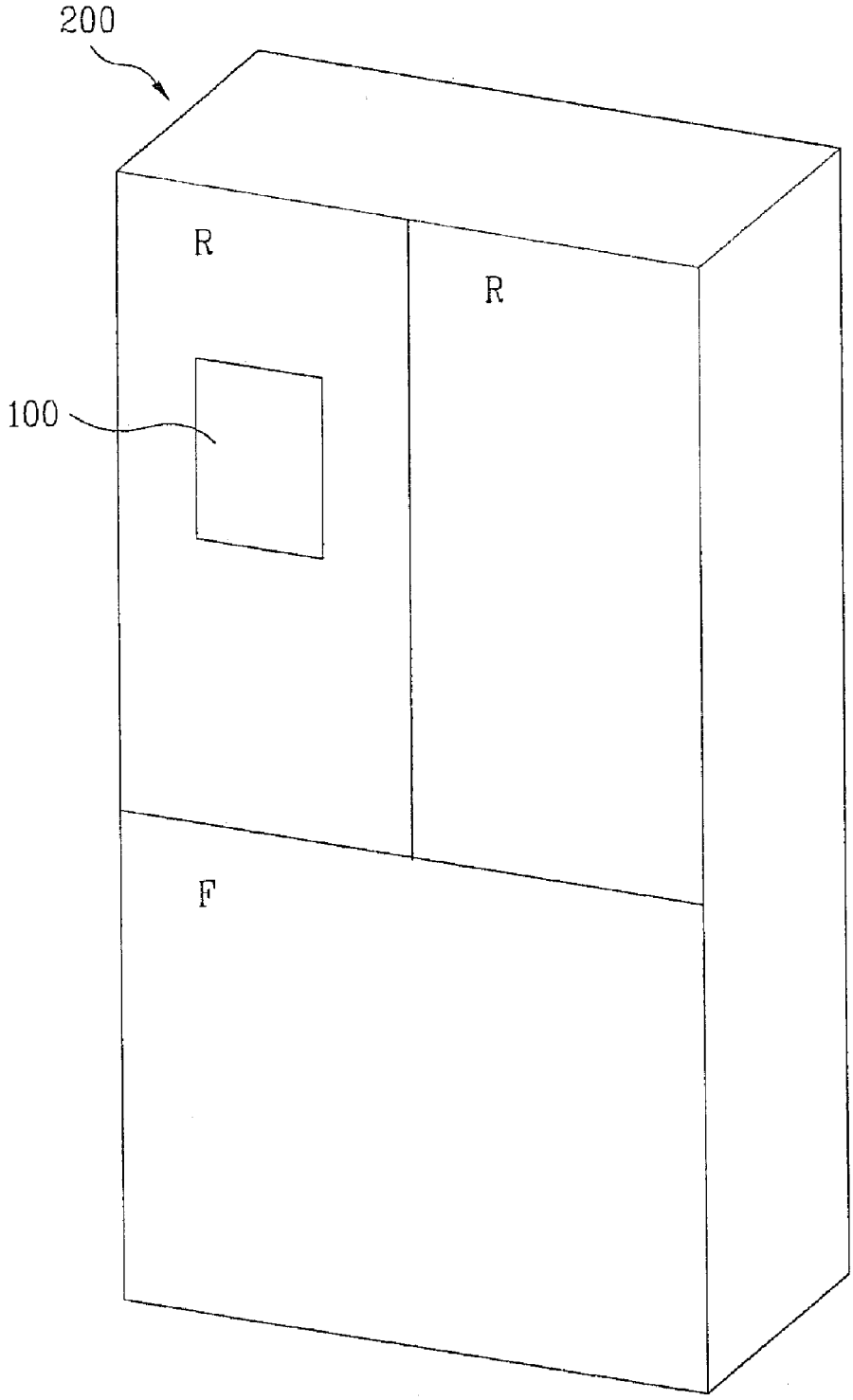
Figure 14D:
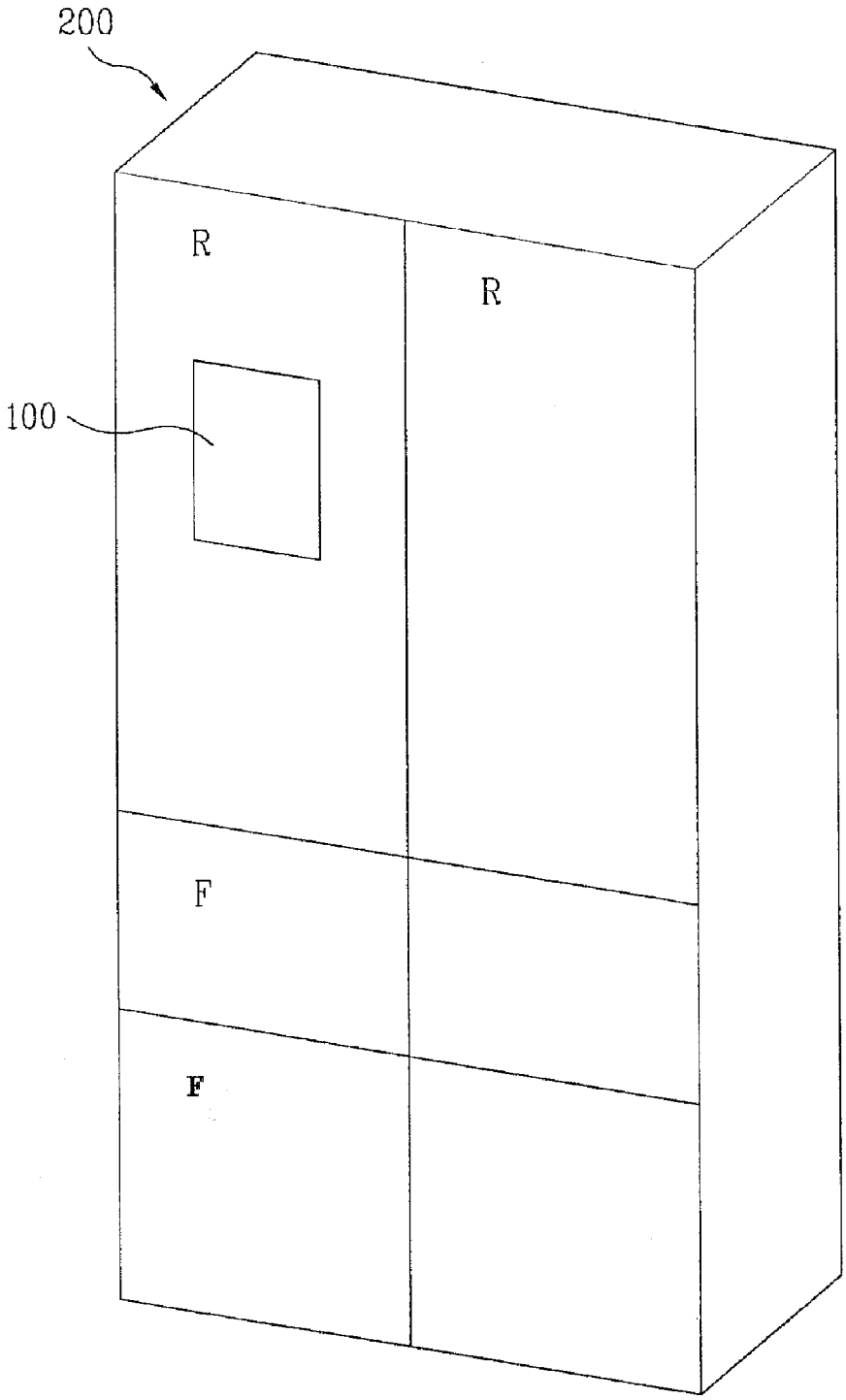
Figure 14E:
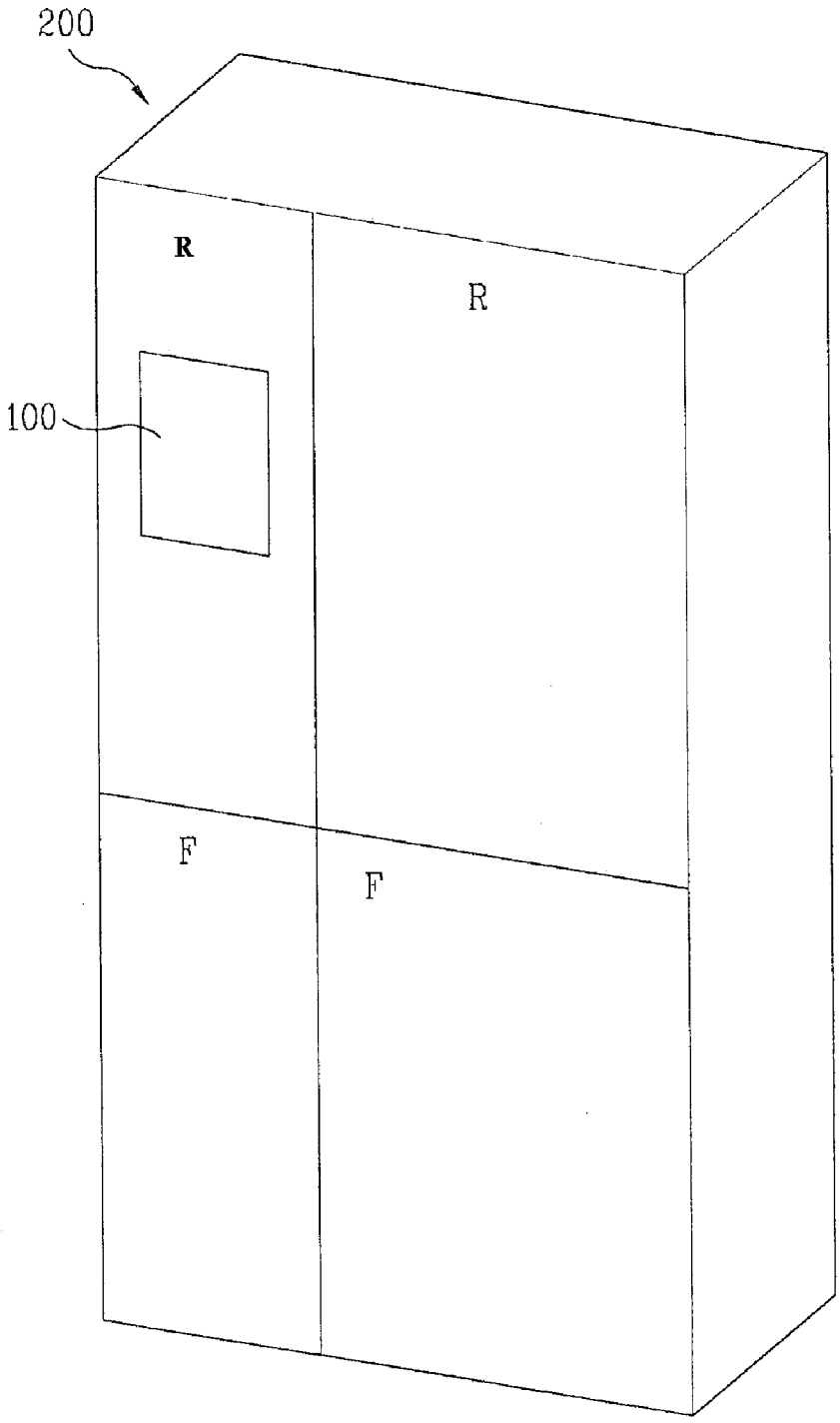
Figure 14F:
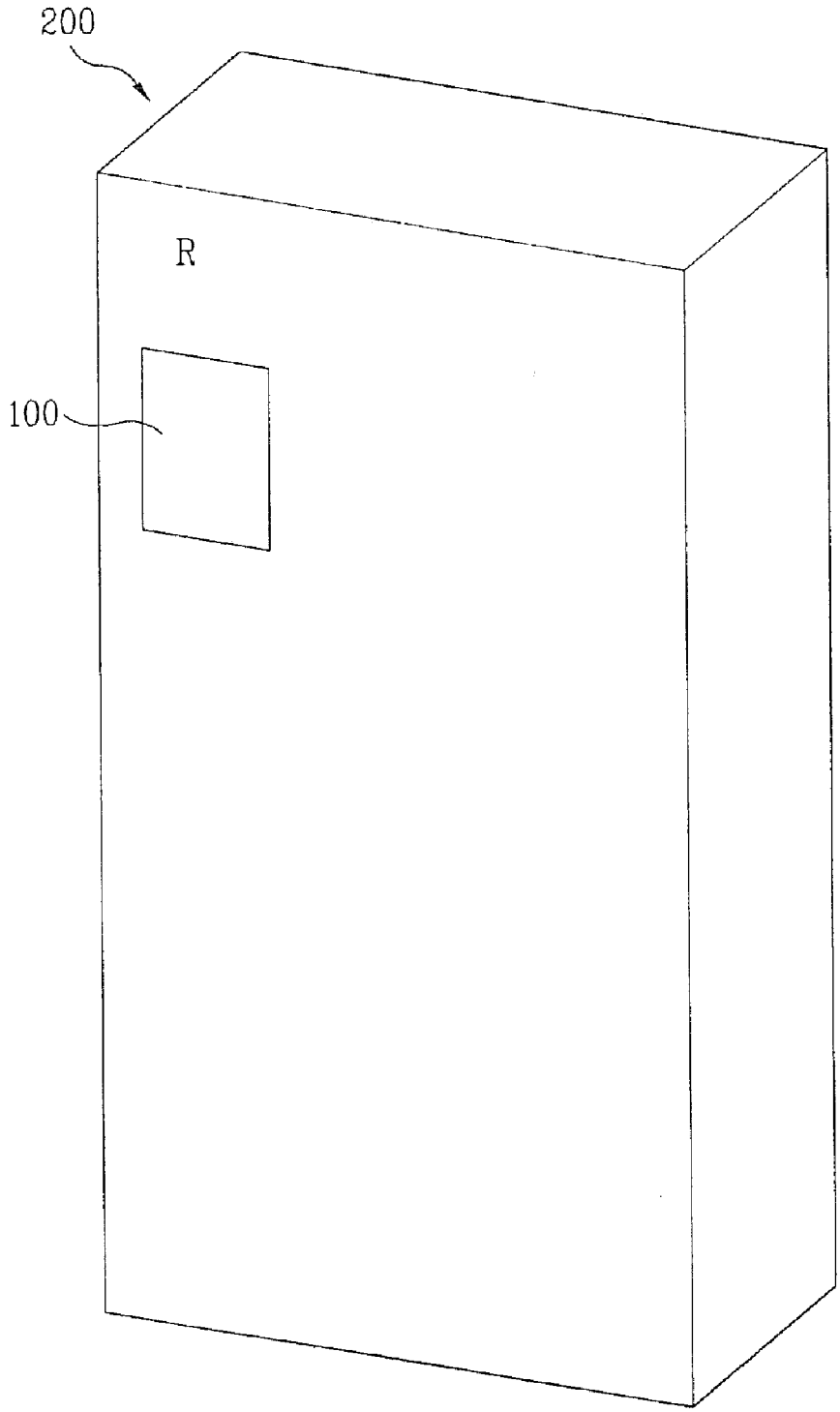
Figure 14G:
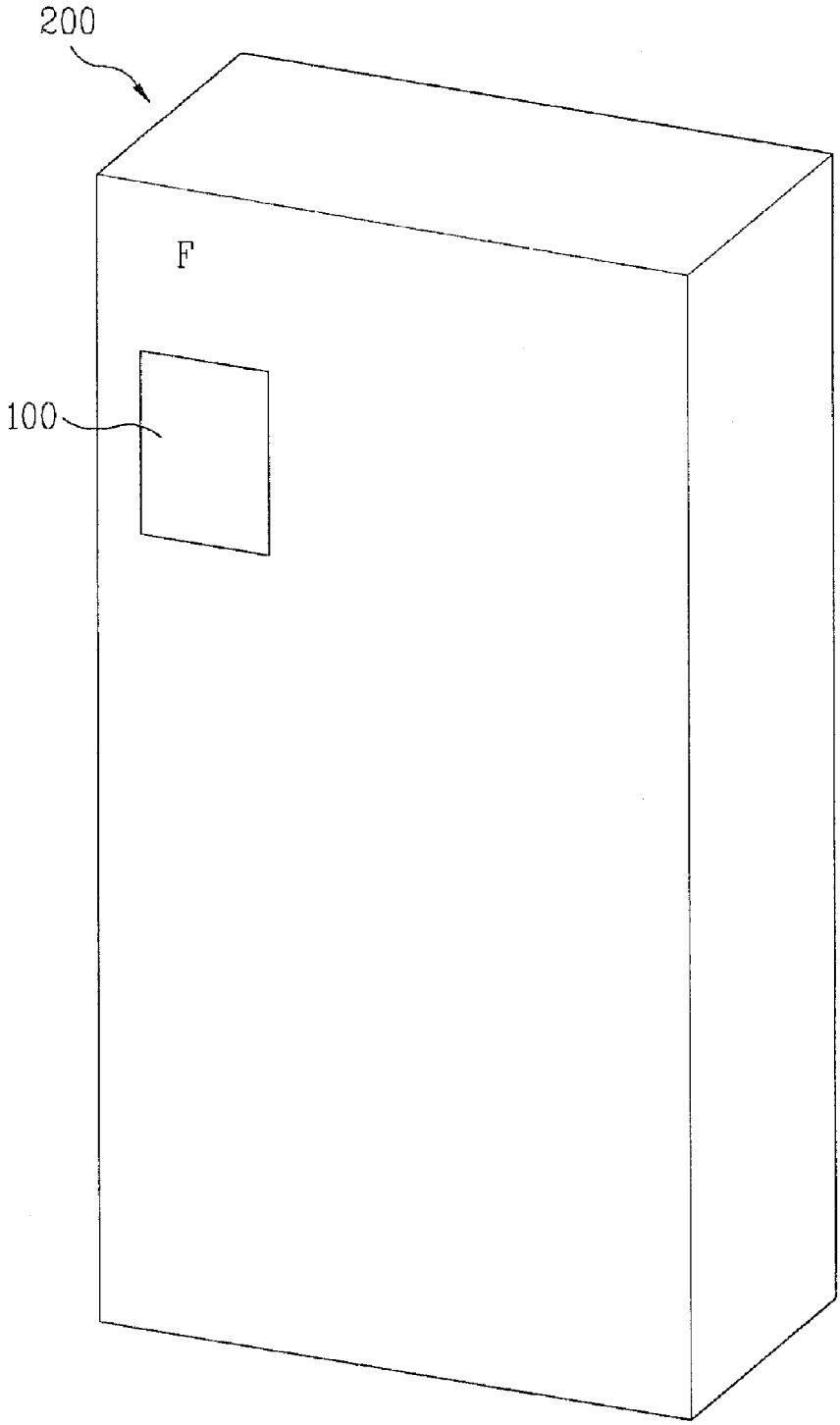

A process of closing the cover 120 of the dispenser 10 will be described with reference to FIGS. 3 and 11-13. FIG. 11 shows the damping member 140 when the cover 120 is fully open. FIG. 12 shows the damping member 140 when the cover 120 has moved from the fully open position to a partially closed position. FIG. 13 shows the damping member 140 when the cover 120 is fully closed.

When the cover 120 is moved so as to shut the ice discharging duct 10, a shutting velocity of the cover 120 has a first velocity period and a second velocity period defined by interaction between the elastic member 130 and the damping member 140. A process of determining a shutting velocity of the cover 120 in the first velocity period will first be described.

When external force is removed from the lever 110, the lever 110 moves back to its original position. As the lever 110 moves back to its original position, the lever 110 receives force from the elastic member 130 and force from the damping member 140 at the same time. Specifically, when the external force is removed, the elastic member 130, which has a stored restoration force due to the rotation of the shaft 157 when the cover 120 is opened, exerts the restoration force on the shaft 157, and the shaft 157 rotates clockwise to close the cover 120.

When the shaft 157 rotates in the cover-closing direction (clockwise), the rotation of the shaft 157 causes the converter 155 to rotate. The converter 155 rotates the second link 153*c* counterclockwise. When the second link 153*c* rotates, the first link 153*b* together with the second link 158*c* rotates counterclockwise. That is, the first link 153*b* receives a counterclockwise moment M2. When the first link 153*b* rotates counterclockwise, the first link 153*b* pushes the damping member 140 toward the right as shown in FIG. 11.

That is, the damping member 140 receives a second compressive force F6 in response to the movement of the first link 153*b*. The first damping part 141 pushes the third damping part 143 due to the second compressive force F6. Then, the third damping part 143 generates a third elastic restoration force F7 in the direction opposite to the moving direction of the first damping part 141. Since the third damping part 143 has already been compressed while the cover 120 is closed, the third damping part 143 has a stored elastic restoration force in the direction opposite to the direction of the second compressive force F6.

The rotation of the first link 153*b* is limited by the third elastic restoration force F7 of the third damping part 143. The limitation in movement of the first link 153*b* influences the rotation of the second link 153*c*. Further, the influence on the rotation of the second link 153*c* affects the shaft 157. As a result, a rotational velocity, i.e., a shutting velocity of the cover 120 is influenced.

Since the elastic restoration force stored by the shaft 157 may be relatively large, the door 120 continuously rotates toward the open position. When the shaft 157 is continuously rotated by the elastic member 130, as shown in FIG. 12, the first link 153*b* and the damping member 140 are arranged in a straight line. In this case, a third elastic restoration force F8 of the third damping part 143 has a maximum value. The rotational velocity of the cover 120 may thus be determined by the compressive force which is applied to the damping member 140 by the elastic member 130 and the restoration force of the damping member 140 which is compressed when the cover 120 is opened, the compressive force and the restoration force being exerted in the opposite directions.

As the elastic member 130 continues to rotate to close the cover 120, the cover 120 enters a second velocity period. Specifically, when the shaft 157 continuously rotates clockwise due to the restoration force of the elastic member 130, the second link 153*c* rotates counterclockwise and the first link 153*b* rotates counterclockwise together with the second link 153*c*. Then, the first link 153*b* draws the first damping part 141 by a second tensile force F9. The first damping part 141 moves toward the left as shown in FIG. 13 due to the second tensile force F9 of the first link 153*b* and a fourth elastic restoration force F10 of the third damping part 143 that is compressed.

That is, the second tensile force F9 and the fourth elastic restoration force F10 which are applied to the first damping part 141 by the elastic member 130 and the third damping part 143, respectively, are exerted in the same direction, i.e., toward the left in FIG. 13. Thus, since the second tensile force F9 and the fourth elastic restoration force F10 are exerted in the same direction, the rotational velocity of the first link 153*b* increases, thereby increasing the shutting velocity of the cover 120 in the second velocity period.

As a result, when the cover 120 is closed, the shutting velocity of the cover 120 has a first velocity period and a second velocity period due to the interaction of forces generated by the elastic member 130 and the damping member 140. In the first velocity period, the cover 120 moves slowly because forces caused by the elastic member 130 and the damping member 140 are exerted in the opposite directions. In the second velocity period, the cover 120 moves more quickly because forces generated by the elastic member 130 and the damping member 140 are exerted in the same direction.

As described above, while the cover 120 is closed, the cover 120 moves slowly at first and, after a predetermined time period, the cover 120 moves more quickly. Accordingly, only ice that is being discharged through the ice discharging duct 10 is discharged from the dispenser 100. The cover 120 is closed before any additional ice can be discharged.

The exemplary dispenser presented herein may be easily applied to a variety of different types of refrigerating systems in which this type of dispensing of contents such as, for example, fluids and/or ice, is required and/or advantageous.

More specifically, the various embodiments of an opening/closing structure for a dispenser as embodied and broadly described herein have numerous applications in different types of refrigerating systems. FIGS. 14A-14G each show a refrigerating system 200 that includes one or more refrigerating chambers R and one or more freezing chambers F. Each refrigerating system 200 shown in FIGS. 14A-14G includes a dispenser 100 as embodied and broadly described herein. Installation and functionality of dispensers in refrigerating systems is discussed in detail in U.S. Pat. Nos. 7,076,967, 6,135,173, 6,109,476 and 5,117,654, the entirety of which are incorporated herein by reference.

In a dispenser and a refrigerator including a dispenser as embodied and broadly described herein the cover may be opened or closed through mechanical connection without using a solenoid, thereby reducing the manufacturing cost of the dispenser and the refrigerator including the dispenser.

Further, since the cover may be opened or closed without using a solenoid, noise generated during opening and closing can be decreased.

Additionally, since the shutting velocity of the cover is controlled by interaction between the elastic member and the damping member, contents such as ice can be easily dispensed.

A dispenser as embodied and broadly described herein is capable of opening or closing a cover through mechanical connection, curtailing the manufacturing cost and reducing noises and vibration and a refrigerator including the same.

A dispenser as embodied and broadly described includes a cover which opens or shuts an opening of a duct which guides discharged contents, an actuator which transmits force applied by a user to the cover to open or shut the opening, and a regulator which controls action of the actuator to adjust movement of the cover.

The actuator may include a lever to which the user applies force, and a transmitting unit which transmits the force applied to the lever to the cover.

The transmitting unit may include a shaft provided on a side of the cover, a linking member which moves by the force applied to the lever, and a converter which converts movement of the linking member to rotation of the shaft.

The linking member may include a lever link connected to the lever to rotate by the lever, a first link connected to the lever link to go around in a circle on basis of the lever link, and a second link connected to the first link and the converter to transmit rotating force delivered to the first link by the lever to the converter.

The second link may have bending portions to transmit force to the converter easily and to buffer a load of transmitting force.

The converter may include an actuating member provided on the shaft and actuated by the second link so as to rotate the shaft.

The second link may have an end portion rotatably connected to the actuating member.

The second link may have an end portion in contact with the actuating member such that the end portion of the second link pushes the actuating member.

The dispenser may also include a roller installed on the end portion of the second link.

The converter may include an actuating gear unit including a pinion gear part provided on a portion of the shaft, and a rack gear part provided on a portion of the second link, wherein the pinion gear part engages with the rack gear part which drives the pinion gear part to rotate to actuate the cover.

The regulator may include an elastic member which supplies elastic force to the cover, and a damping member which controls an opening or shutting velocity of the cover by damping force transmitted from the actuator.

The cover may shut the opening in the shutting velocity which has a first velocity period in which the cover moves slowly and a second velocity period in which the cover moves quickly by interaction of the elastic member and the damping member.

A direction of force transferred by the elastic member and a direction of force applied by the damping member may be substantially opposite to each other in the first velocity period.

A direction of force transferred by the elastic member and a direction of force applied by the damping member may be substantially same as each other in the second velocity period.

The cover may be opened while force transferred by the elastic member and force applied by the damping member are exerted in opposite directions and then exerted in the same direction, and the cover may be closed while force transferred by the elastic member and force applied by the damping member are exerted in the same direction and then exerted in opposite directions.

In another embodiment as broadly described herein, a refrigerator may include a case which has at least one cooling room, a door which opens or closes the cooling room, and a dispenser installed in one of the cooling room and the door, wherein the dispenser includes a cover which opens or shuts an opening of a duct which guides discharged contents, an actuator which transmits force applied by a user to the cover to open or shut the opening, and a regulator which controls action of the actuator to adjust movement of the cover.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dispenser for a refrigerator, comprising:

a cover configured to selectively open and close an opening of a duct through which contents are discharged from the dispenser;

an actuator configured to transmit an external force to the cover to selectively open and close the opening; and a damping system configured to interact with the actuator so as to regulate movement of the cover, wherein the damping system includes:

a first elastic member configured to provide an elastic force to the cover; and a damping member configured to control an opening velocity and a closing velocity of the cover, wherein the first elastic member and the damping member are configured to exert forces in opposite directions and then exert forces in the same direction so as to open the cover, and wherein the elastic member and the damping member are configured to exert forces in the same direction and then exert forces in opposite directions so as to close the cover.

2. The dispenser of claim 1, wherein the actuator includes:

a lever configured to receive the external force; and a transmitter configured to transmit the external force received by the lever to the cover so as to move the cover.

3. The dispenser of claim 2, wherein the transmitter includes:

a shaft provided at a side of the cover;

a linking member configured to move in response to the external force applied to the lever; and a converter configured to convert a movement of the linking member to a rotation of the shaft.

4. The dispenser of claim 3, wherein the shaft is provided at a side edge of the cover and the converter is coupled to an end of the shaft, and wherein the linking member has a first end coupled to the lever and a second end that engages the actuator.

5. The dispenser of claim 4, wherein the linking member is configured to rotate about its first end in response to the external force applied to the lever, and the converter is configured to rotate the shaft in response to the rotation of the linking member.

6. The dispenser of claim 3, wherein the linking member includes:

a lever link having a first end connected to the lever and configured to rotate together with the lever;

a first link having a first end connected to a second end of the lever link and configured to rotate together with the lever link; and a second link having a first end connected to the second end of the lever link and a second end configured to engage with the shaft, wherein the second link is configured to transmit rotating force provided to the shaft via the converter.

7. The dispenser of claim 6, wherein the converter includes:

a pinion gear provided on a portion of the shaft; and a rack gear provided on a portion of the second link corresponding to the pinion gear and configured to engage with the pinion gear.

8. The dispenser of claim 7, wherein the rack gear is provided at the second end of the second link, and wherein the rack gear is configured to rotate the pinion gear and the shaft in response to a movement of the lever and a corresponding rotation of the second link about its first end.

9. The dispenser of claim 6, wherein the second link includes at least one bent portion, wherein the at least one bent portion is configured to transmit force to the converter and to buffer a load of the transmitted force.

10. The dispenser of claim 6, wherein the converter includes an actuating member provided on the shaft, wherein the actuating member is configured to be actuated by a movement of the second link so as to rotate the shaft.

11. The dispenser of claim 10, wherein a second end of the second link is rotatably connected to the actuating member.

12. The dispenser of claim 10, wherein a second end of the second link contacts the actuating member such that the second end of the second link pushes the actuating member.

13. The dispenser of claim 12, further comprising a roller installed on the end of the second link.

14. The dispenser of claim 1, wherein the damping member is configured to generate a damping force based on a force applied thereto by the actuator.

15. The dispenser of claim 14, further comprising a second elastic member wherein the second elastic member is configured to interact with the damping member so as to adjust the opening and closing velocity of the cover.

16. The dispenser of claim 1, wherein the damping member comprises:

a first damping part; and a second damping part, wherein the first damping part is configured to be slidably inserted into and coupled to the second damping part.

17. The dispenser of claim 16, further comprising a second elastic member provided within the second damping part and positioned between the first damping part and the second damping part.

18. The dispenser of claim 17, wherein the second elastic member is configured to expand or contract based on a movement of the actuator and a corresponding relative movement between the first and second damping parts.

19. The dispenser of claim 18, wherein the second elastic member is one of a coil spring, a gas spring, or a hydraulic cylinder.

20. The dispenser of claim 1, wherein the closing velocity has a first velocity period and a second velocity period, and wherein the cover moves more quickly in the second velocity period than in the first velocity period.

21. The dispenser of claim 20, wherein a direction of force generated by the first elastic member is substantially opposite to a direction of force generated by the damping member during the first velocity period.

22. The dispenser of claim 20, wherein a direction of force generated by the first elastic member is substantially the same as a direction of force applied by the damping member during the second velocity period.

23. A refrigerator comprising the dispenser of claim 1.

24. A refrigerator, comprising:

a main body having at least one storage chamber formed therein;

a door rotatably coupled to the main body; and a dispenser installed in one of the storage chamber or the door, wherein the dispenser includes:

a cover configured to selectively open or close an opening of a duct that discharges contents from the dispenser;

an actuator configured to transmit an external force to the cover so as to selectively open or close the opening; and a damping system configured to control the actuator so as to regulate movement of the cover, wherein the damping system includes:

a first elastic member configured to provide an elastic force to the cover; and a damping member configured to control an opening velocity and a closing velocity of the cover, wherein the first elastic member and the damping member are configured to exert forces in opposite directions and then exert forces in the same direction so as to open the cover, and wherein the elastic member and the damping member are configured to exert forces in the same direction and then exert forces in opposite directions so as to close the cover.

25. A dispenser for a refrigerator, comprising:

a cover configured to selectively open and close an opening of a duct through which contents are discharged from the dispenser;

an actuator configured to transmit an external force to the cover to selectively open and close the opening; and a damping system configured to interact with the actuator so as to regulate movement of the cover, wherein the damping system includes:

a first elastic member configured to provide an elastic force to the cover; and a damping member configured to control an opening velocity and a closing velocity of the cover, wherein the closing velocity has a first velocity period and a second velocity period, wherein the cover moves more quickly in the second velocity period than in the first velocity period.

26. The dispenser of claim 25, wherein a direction of force generated by the first elastic member is substantially opposite to a direction of force generated by the damping member during the first velocity period.

27. The dispenser of claim 25, wherein a direction of force generated by the first elastic member is substantially the same as a direction of force applied by the damping member during the second velocity period.

* * * * *